US007467847B2

(12) United States Patent
Baxter et al.

(10) Patent No.: US 7,467,847 B2
(45) Date of Patent: Dec. 23, 2008

(54) PRINTING APPARATUS AND METHOD

(75) Inventors: William Ronald Stuart Baxter, Cambridge (GB); Richard William Eve, Cambridge (GB)

(73) Assignee: Inca Digital Printers Limited (GB)

( * ) Notice: Subject to any disclaimer, the term of this patent is extended or adjusted under 35 U.S.C. 154(b) by 146 days.

(21) Appl. No.: 10/482,438

(22) PCT Filed: Jun. 24, 2002

(86) PCT No.: PCT/GB02/02881

§ 371 (c)(1),
(2), (4) Date: Jul. 26, 2004

(87) PCT Pub. No.: WO03/002349

PCT Pub. Date: Jan. 9, 2003

(65) Prior Publication Data

US 2004/0252174 A1 Dec. 16, 2004

(30) Foreign Application Priority Data

Jun. 27, 2001 (GB) ..... 0115719.7

(51) Int. Cl.
*B41J 2/145* (2006.01)

(52) U.S. Cl. ..... 347/41

(58) Field of Classification Search ..... 347/41
See application file for complete search history.

(56) References Cited

U.S. PATENT DOCUMENTS 4,063,254 A * 12/1977 Fox et al. ..... 347/41
4,843,958 A 7/1989 Egosi
5,317,337 A 5/1994 Ewaldt
6,386,667 B1 5/2002 Cariffe
6,900,826 B2 * 5/2005 Williams et al. ..... 347/248

FOREIGN PATENT DOCUMENTS

| | | |
|---|---|---|
| EP | 0 209 896 | 1/1987 |
| EP | 0 952 003 | 10/1999 |
| EP | 1 065 055 | 1/2001 |
| GB | 2 180 195 | 3/1987 |
| JP | 2-185444 | 7/1990 |
| JP | 3-248843 | 11/1991 |
| JP | 8-207265 | 8/1996 |
| JP | 8-300741 | 11/1996 |
| JP | 10-278376 | 10/1998 |

* cited by examiner

*Primary Examiner*—Julian D Huffman
(74) *Attorney, Agent, or Firm*—Harness, Dickey & Pierce, P.L.C.

(57) ABSTRACT

A printing apparatus is adapted for printing on a printing surface of a three-dimensional object 12. The apparatus comprises an inkjet printhead 14 having a plurality of nozzles, and being operative to effect relative movement of the printhead and the object, during printing, with a rotational component about an axis of rotation and with a linear component, in which the linear component is at least partially in a direction substantially parallel with the axis of rotation and wherein the nozzle pitch of the printhead is greater than the grid pitch to be printed onto the printing surface in the nozzle row direction. In preferred examples, a substantially helical path is printed on the surface and improved ink jet printing of three dimensional objects can be achieved.

24 Claims, 8 Drawing Sheets

Non-interleaved printing grid pattern for single 24-nozzle with P=5 (as per Fig. 6)

Print pattern for a 72 nozzle printhead with P=7 and an interleave K=3 in the helix direction

PRINTING APPARATUS AND METHOD

This invention relates to a printing apparatus and method. In particular, but not exclusively, this invention relates to apparatus and a method for printing on three-dimensional objects using inkjet printing, and to printing curved surfaces.

A variety of techniques are presently used to print onto three-dimensional objects, including screen-printing and offset printing. The object is usually presented to the printer by an automatic handling system, and is rotated while the offset blanket or screen applies the image.

Such conventional techniques have several drawbacks. For example, registration between colours is difficult to maintain, so that half-tone images using process colours can rarely be printed at good quality. Additionally, changing images requires lengthy setting up of new screens, plates and so on. With the trend being that print run lengths are shortening, product varieties are increasing, and packaging variants (for example special offers) are becoming more frequent, this latter disadvantage is particularly significant. There is, therefore, a demand for a printing technique which allows rapid changeover between images, and which allows process colour half-tone images to be printed at high quality onto objects.

Inkjet printing with multi-nozzle printheads is widely used to print upon flat substrates such as paper, board, textiles and films. wet printing is known to allow rapid—effectively instantaneous—changeover of images. High-quality inkjet printing is also known to allow excellent half-tone images to be printed using process colours. In principle therefore, inkjet can be recognized as an excellent solution to at least some of the problems of known techniques. However, it is difficult to implement multi-nozzle inkjet printing onto non-constant radius surfaces, for example curved surfaces. One source of difficulty in printing such three-dimensional objects arises because multi-nozzle printheads typically have flat nozzle plates, with the array of nozzles arranged either in one straight line (for example commercially available printheads from XaarJet and Spectra) or in a two-dimensional array (for example commercially available printheads from Aprion, Hewlett Packard and Epson).

One constraint on the application of multi-nozzle inkjet printheads to curved surfaces is that the distance from all the nozzles to the surface must be kept small during printing (typically less than 2 mm for highest quality printing). Another practical limitation is when the object to be printed must be presented to the inkjet printhead(s) by an automated system which:

a) places the object in the correct position relative to the printhead(s);
b) turns the object along its principal axis such as to allow the area to be printed to pass in front of the printhead(s); and then
c) takes the object away, thus allowing the next object to be presented.

The automated system typically grips the parts to be printed by the neck and moves them sideways (usually perpendicular to the principal axis). The part must, therefore, be free to move in and out of the printing station, which restricts the number of printheads which can be arranged around the part.

A further problem with producing high-quality print is the occurrence of nozzle defects. These cause a defect in the print output of the print head, which can result in a visible line defect in the printed product.

An aim of this invention is to enable the use of commercially available printheads in printing such curved three-dimensional objects. A particular, but not exclusive, application of the invention lies in printing objects in which the printed area (which typically covers only a part of the complete surface area of the object) is curved in one direction and substantially linear in another. Examples of such substrates are tubs, tubes, cans and bottles which are widely used to package foodstuffs, beverages, cosmetics, personal care substances, medications and DIY products.

According to a first aspect of the invention, there is provided printing apparatus for printing on a printing surface of a three-dimensional object, the apparatus comprising an inkjet printhead preferably having a plurality of nozzles, and being operative to effect relative movement of the printhead and the object, during printing, with a rotational component about an axis of rotation and with a linear component, in which the linear component is at least partially in a direction substantially parallel with the axis of rotation.

By combining a linear and rotational relative movement, the print head can be caused to print on the entire printing surface, or any desired region of it, preferably in a single scan of one or more printheads.

It will be understood that the relative movement can be effected by moving only the printhead or printheads, by moving only the substrate to be printed, or by moving both the printheads and substrate.

Preferably the printhead comprises a nozzle array which preferably comprises one or more nozzle rows. As described in more detail below, the apparatus may comprise more than one nozzle row. These nozzle rows may all be provided on a single printhead, or by several printheads. In preferred examples, the nozzle row is aligned with the direction of traverse of the printhead relative to the surface to be printed.

The method described is especially, but not exclusively, suitable for printing objects that have a principal axis, and that have surfaces that can be generated by the complete or partial rotation of a straight line around the principal axis. The simplest example is a cylindrical surface (typical of cans), which is generated by a straight line parallel to the principal axis, rotated at a constant radius. Another example is a conical or frusto-conical surface (typical of yoghurt pots), which is generated by the rotation at a constant radius around the principal axis of a straight line in a plane containing the principal axis but angled to it. Another example is typical of some shampoo bottles, which have a printed surface that is generated by the rotation around the principal axis of a straight line in a plane containing the principal axis, while varying the radius of rotation.

Surfaces such as those described above can be printed using multi-nozzle inkjet printers, for example by ensuring that the line or array of nozzles is aligned closely with the notional line that generates the printed surface. The number of printheads which can be used at a single print station is however often limited by:

a) how closely printheads can be packed around the object while keeping the nozzles close enough to the surface and aligned with the generator line;
b) the necessity of allowing enough clearance for the object to be moved in and out of the print station by an automatic handling system;
c) packing more printheads around the object does not normally result in a proportionally higher throughput because the transfer time is typically similar to the print time: the printer can therefore be less cost-effective with more printheads because the printheads are a large proportion of the total machine cost; and d) printheads (in some cases) operate better when jetting vertically downwards, or at least with a downward component of velocity.

In practice, the objects are often presented to the printer by moving them in a direction perpendicular to their principal axis. For the reasons outlined above, the number of printheads that can be used at a print station is often limited to fewer than would be needed to print the surface(s) in a single rotation. Therefore each nozzle has to print more than one area of the object, and has to be moved relative to the object accordingly.

An aim of this invention is to allow objects to be finally printed in a single scan at high quality using one or more nozzle arrays of length less than the object to be printed. A broad aspect of the invention provides ink jet printing in a helix around the principal axis of a part of the object.

While aspects of the invention find particular application where the nozzle array is shorter than the object or part of the object to be printed, parts shorter than the nozzle array may also advantageously be printed in this way.

For example, if the part to be printed is shorter than the nozzle array it would be possible to print it in a tight helix, for example starting with the nozzle row spanning the entire length of the part to be printed (rather than, for example, starting the printhead at one end of the part and traversing the printhead right across the part). This can provide fast printing of images smaller than the length of the nozzle array.

Where reference is made to a printhead, the printhead may comprise a nozzle array, for example one or more nozzle rows. Furthermore, where reference is made to more than one printhead, the plurality of printheads may be provided by a single printhead having a plurality of nozzle rows, or a group of printheads each having at least one nozzle row. Also, where reference is made to a plurality of nozzle rows, those rows may be provided by one or more printheads.

Preferably, the relative motion of the object and the printhead will include both linear and rotational components simultaneously. For example, this may give rise to a substantially helical printing path, for the printhead (and for each of its printing nozzles). This is a particularly advantageous feature and may be provided independently. Thus an aspect of the invention provides printing a print path on a curved part, the print path being substantially helical.

While in preferred embodiments a strict or near-strict helix is printed, the path need not be a strict helix. Thus preferably the terms helix and helical should be understood to include all paths having a rotational and transverse component to form a spiral around the object. In some applications, not all of the surface of the object may be printed, and thus it should be understood that the printed path may comprise only section of a helix.

The helix angle may vary along the length of the object. Preferably the helix angle is only a few degrees, for example the transverse movement might be about one sixth of the print pitch over the circumference of the object.

Typical embodiments of the invention are operable to print on a three-dimensional object in which the printing surface is curved in a first direction and substantially flat or linear in a second direction. The first and second directions need not be orthogonal. In such embodiments, the rotational component is preferably arranged to follow the first direction of the printing surface. The printing surface may be at non-constant radius with respect to the axis of rotation. In cases where the object has a principal axis, the axis of rotation is preferably substantially parallel to or coincident with the principal axis. Moreover, the linear component is preferably directed substantially parallel to the second direction of the printing surface.

It is to be understood that the linear motion need not be parallel to the axis of rotation, although it will typically be parallel when printing upon a printing surface that is, or is part of, the outer surface of a cylinder. Such a printing surface may, for example, be part of an outer surface of a cylindrical object such as a beverage or food can, or might be part of a cylindrical portion of an object such as a bottle.

In other cases, the linear motion may be angled with respect to the axis of rotation. This may be applicable when the printing surface is or is part of a cone or frustum. Such a printing surface might, for example, be found on a food container e.g. a yoghurt pot.

Another class of printing surfaces may be defined by rotation around the principal axis of a straight line in a plane that does not contain the principal axis. Such surfaces are typically hyperbolae of revolution, and can generate a waisted shaped object. A particular problem encountered in printing such surfaces arises because a printhead with a nozzle plate of finite width must typically be presented to a surface that is twisted along the generator line. It has been found that it may be advantageous, in embodiments of the invention that are intended to print on such surfaces, to rotate the (one or more) printhead as it is moved along the generator line so that the printhead (and in particular, the edges of the nozzle plates) does not interfere with the surface.

An aspect of the invention provides apparatus for printing on a three-dimensional object, the object having a principal axis and a printing surface that is curved in a first direction and substantially flat in a second direction, in which the rotational component of the relative motion between the object and the printhead is substantially parallel to the first direction and the linear component of the relative motion between the object and the printhead is substantially parallel to the second direction.

Preferably the nozzle pitch of the printhead is greater than the grid pitch to be printed onto the printing surface in the nozzle row direction. In some arrangements the fill print grid can be printed in one scan of one or more printheads. In this case, other nozzles of the nozzle array can fill in the print grid. The scan comprises preferably movement, for example linear movement, of the printhead relative to surface.

This feature is of particular importance and is provided independently. Thus an aspect of the invention provides printing apparatus for printing on a printing surface of an object, the apparatus comprising an inkjet printhead, preferably comprising a plurality of nozzles, and being operative to effect relative motion of the printhead and the object, wherein the nozzle pitch of the printhead is greater than the grid pitch to be printed in the nozzle row direction, the arrangement being such that substantially the full print grid can be printed in one scan of the printhead.

The printhead may comprise several rows of nozzles, which may be arranged on several actual individual printheads. Also provided by an aspect of the invention is an ink jet printing apparatus for printing a printing surface of a 3 dimensional object, the apparatus comprising a first row of nozzles having a nozzle pitch greater than the grid pitch to be printed in the nozzle row direction, for printing a first substantially helical path on the surface, and further comprising a second row of nozzles, preferably different from the first row, for printing a second substantially helical path adjacent the first substantially helical path.

In embodiments of the invention described below, fewer than all of the nozzles of a nozzle array and/or a printhead may be used for printing. Preferably, the number of nozzles used for each scan of a printhead is chosen such that the number of nozzles N has no common factor with P, for a printhead having nozzles at a pitch P times the desired pitch of the printing pattern in the direction of the nozzle row. This allows the print grid to be fully filled by a scan of one or more nozzle rows. Indeed, that feature is of particular importance and is provided independently.

For example, for a printhead where P=7, 24 nozzles might be used (N=24) for printing.

In examples described below, the relative movement of the printhead and the part in the direction of the nozzle row is LN for each revolution of the part relative to the printhead, where L is the pitch of the printing pattern in the direction of the nozzle row, and N is the number of nozzles used. Where a set of nozzle rows in parallel is used (for example as shown in FIG. 2*a*), N is the total number of nozzles used in all the parallel rows. For a set of nozzle rows in series (FIG. 2*b*), the formula is again LN, where N is the number of nozzles used. Where interleaving is used (see below), the relative movement is LN/K, where K is the number of interleaves in the helix direction.

In some preferred examples, the apparatus comprises more than one nozzle row, which may be provided by more than one printhead, preferably at least some of the nozzle rows being offset so that the full print grid can be printed in a single scan of the nozzle rows. The nozzle rows may be arranged in parallel and/or in series, when using nozzle rows in parallel (as in FIG. 2*a* described below), preferably the nozzle rows of the printhead(s) are offset by PK+P/X with respect to the print grid as shown in FIG. 2*a* described below, where X is the number of nozzle rows and K is an integer greater than 1. Preferably K=0 (otherwise 2K nozzles are wasted). P/X is an integer. The grid is itself angled with respect to the rotational direction.

For nozzle rows in parallel, the offset of the $M^{th}$ nozzle row is (M−1)/X times the nozzle pitch compared to the first nozzle row. As indicated above, P/X is an integer greater than one. For nozzle rows in series, the offset is the length of the nozzle row plus one nozzle pitch. The offset should be relative to the helix angle of the grid.

The helix angle of the grid is preferably the angle of the printed helix relative to a line normal to the principal axis in the same plane. The helix angle at any point is $\tan^{-1}$ (printhead speed/rotational speed).

Considering FIG. 2*a*, in order to have nozzle rows in parallel, they should be interleaved in the direction of the nozzle row (an interleave of three in FIG. 2*a*). This interleave should be set up as shown relative to the print grid, one axis of which lies along the helix direction. If it is set up relative to the direction of rotation, the interleave is likely to be incorrect.

A consequence of this is that nozzle rows in parallel or in series should in general be set up differently for different print jobs. Only if the helix angle is the same will the set up work perfectly. In practice, the print jobs would probably be designed such that the helix angle does stay substantially the same.

It is thought that in most applications more than one nozzle row will be used. These may be provided by more than one printhead, or printheads having more than one nozzle row may be used. In the latter case, there can be a problem fitting the nozzle positions to the grid pattern. A slight angling of the printhead may be needed so that the various nozzle rows line up with the helical grid (see, for example, FIG. 2*a* described below). In practice, this has been found not to be a great problem since the distance between nozzle rows is usually large compared with the print grid so that a small angle is sufficient to align them. When the print is to be interleaved in the helix direction (for example, as described below) the problem can be over-constrained and a "best fit" position may have to be found in which the drop placement is not quite mathematically correct either in terms of helix spacing or droplet position along the helix. However, it has been found for this compromise solution that the worst error in practice is often within acceptable tolerances. Thus, preferably, the apparatus includes means, preferably a mounting device, for mounting a printhead having more than one nozzle row, the apparatus further comprising means for angling the printhead at an angle, having regard to the print grid relative to the nozzle rows.

When printing on objects that have a non-constant radius in relation to their rotational component of movement, steps must preferably be taken to ensure that printing is of uniform density and consistency. For example, the generator line of the surface to be printed may be substantially parallel to the principal axis, but the distance between the generator line and the principal axis varies as the object rotates, for example the bottle shown in FIG. 5.

An aspect of the invention provides printing apparatus (optionally in accordance with other aspects of the invention) for printing on a printing surface of a three-dimensional object, the apparatus comprising an inkjet printhead, preferably including a plurality of nozzles, and being operative to effect the relative movement of the printhead and the object, during printing, with a rotational component about an axis of the object, in which the rotational component causes motion of the printing surface past a nozzle of the printhead with a substantially constant linear velocity.

This arrangement can facilitate the production of ink dots at a constant linear spacing on the printing surface, thereby assisting the maintenance of a constant print density and quality. Keeping a constant relative surface speed maintains a fixed print grid when the generator line is parallel to the principal axis, and helps to limit distortion when it is at an angle. Even where the nozzle row is at an angle to the principal axis improvements in print quality can be obtained.

Preferably, in this arrangement the object is rotated with a variable angular velocity with respect to the printhead.

When the generator line is parallel to the print axis, a substantially "perfect" print grid could be obtained simply by varying the angular velocity. Alternatively, or in addition, the printing can be carried out by varying the print density as described further below. Variation of the print density may be easier to achieve in many cases.

Preferably the apparatus is adapted to control the density of the printed image.

This feature is of particular importance and is provided independently. Thus an aspect of the invention provides printing apparatus for printing an image on a non-constant radius printing surface, the apparatus comprising an inkjet printhead and being operative to effect relative movement of the printhead and the surface, the apparatus being adapted to control the density of the printed image.

Preferably the apparatus is adapted to maintain a substantially constant density of the image independent of the radius of the surface being printed.

This feature is of particular importance and is provided independently. Thus the invention further provides a printing apparatus for printing an image on a non-constant radius printing surface, the apparatus comprising an inkjet printhead and being operative to effect relative movement of the printhead and the surface, the apparatus being adapted to maintain a substantially constant density of the printed image independent of the radius of the surface being printed.

According to a further aspect of the invention, there is provided a control apparatus for controlling an inkjet printer, the apparatus being adapted to maintain a substantially constant density of the image independent of the radius of the surface being printed.

Also provided by the invention is a control apparatus for controlling an inkjet printer for printing an image on a non-constant radius printing surface, the apparatus being adapted to control the density of the printed image dependent on the radius of the surface being printed.

Various methods are proposed below for controlling the image density.

In preferred embodiments of the invention the printhead moves continuously at or near its maximum speed.

If, for example, the object is being rotated at a constant angular velocity, a surface to be printed at a region of large radius will be moving faster relative to the printhead than a region of small radius. Thus if the nozzles are fired at a constant rate, the image printed on the area of small radius will be significantly denser.

This is not a problem which would be encountered, for example, with screen printing of an object since the ink density would be the same at smaller radius, even if the print grid were finer.

According to a preferred embodiment of the invention, the apparatus is adapted to control the relative speed of movement of the printhead and the surface dependent on the radius of the surface.

Thus, the relative speed can be increased as the radius decreases to maintain the grid pitch. For example, the angular velocity of the object being printed can be varied according to the radius.

For example, the drive for effecting the rotation of the object can be controlled by a control device which adjusts the angular velocity according to a predetermined sequence determined in view of the shape of the surface to be printed.

While that technique can give acceptable results, there is a variation in relative speed of the printhead and the surface and, where the printhead is of a significant width, that can lead to noticeable variation in the printed image. Also, the variation in relative speed can lead to a variation in the time of flight of the ink drop from the nozzle to the surface and thus problems. Also, the change in the speed can lead to variations in the helix angle where a helical path is being printed. Also, it is generally preferred to run the printer at the maximum possible speed.

In an alternative arrangement the apparatus is adapted to vary the print pitch (preferably the pitch along the helix) during printing dependent on the radius of the surface being printed. In this way the colour intensity of the printed surface can be made more uniform for a surface of variable radius.

The "radius of the surface" preferably relates to the radius of the surface from the axis of rotation.

Alternatively, or in addition, the traverse speed of the printheads is varied.

Thus the apparatus may be adapted to vary the speed of relative movement of the printhead and the surface during the printing dependent on the radius of the surface being printed.

The apparatus may be adapted to vary the frequency of droplets emitted by the nozzle dependent on the radius of the surface at the nozzle.

For example, where the firing of the printhead nozzles depends on the timing of a clock signal, for example an encoder on the axis of rotation, the encoder signal could be reduced in frequency at small radius and increased at larger radius using a control device.

Alternatively, or in addition, the apparatus is adapted to vary the density of the droplets deposited. Thus by varying the density of the droplets according to the radius of the surface, the density of the printed image can be controlled.

Alternatively, or in addition, the apparatus is adapted to vary the size of a droplet emitted from a nozzle dependent on the radius of the surface being printed.

For example, the amount of ink in a droplet can be reduced to reduce the density.

Alternatively, or in addition, the apparatus is adapted to prevent the printing of one or more dots of the print image dependent on the radius of the surface.

By removing dots from the print image, the density can be reduced. For example, when the radius reduces below a predetermined value the printer might remove every fifth dot from the print image. However, such a sudden change might be too visible in the printed image; preferably the change is made more gradually.

Preferably, the apparatus is adapted such that the probability of removing a dot increases as the radius decreases.

For example, the probability of removing every other dot may increase from 0 to 1 from the widest part of the surface to the narrowest part. Thus there is no distinct step in density of the printed image.

Where the rotational velocity of the object remains constant, preferably the probability of removing a dot is proportional to the radius.

The invention further provides a printer including a control apparatus as described herein.

The changes to the print image can be carried out at the printer. However, there can be a problem with image distortion and thus in some cases it is preferred to carry out the changes to the image at the image processing stage. Such changes may be carried out, for example, by the designer.

The present invention also provides an image processing apparatus for processing an image for an inkjet printer, the apparatus being adapted to change the density of the image to be printed dependent on the radius of the surface to be printed.

The image processing apparatus preferably is adapted to adjust the image in one or more of the ways indicated above, for example by adjusting the pitch between grid points to be printed, adjusting the colour density of particular droplets and/or removing grid points to be printed.

By carrying out the processing of the image off-line, the grid print pattern to be printed can be optimized for particular object shapes to be printed. The density correction preferably changes the image to be printed.

Preferably the image is adjusted for density before it is processed to convert it into printer-compatible format. For example, where a RIP is used, preferably the density adjustments are made before or at the front end of the RIP. The density adjustment can add noise to the image; if the density is adjusted before conversion, the visual effect of the noise can be reduced.

These techniques work particularly well for objects having a small variation in radius (for example yoghurt pots), but can also be used for other objects. Examples of the technique may be effected by choosing a 'normal' print grid for the maximum radius, and then reducing the colour density proportionately at smaller radii. The adjustment can be applied to each part of the image according to its position and thus the radius at that position. This can be done globally using an algorithm.

By combination of those methods, a large range of different objects can be printed.

There are advantages to carrying out interleaving in an inkjet printing process, in which each line of print is made up from dots laid down in successive passes, by different nozzles. For example, every other dot on a print gridline may be made in a first pass by a first nozzle, and then the remaining dots may be made during a second pass by a second nozzle, or by a different nozzle in the same pass (this example being an interleave of 2).

Preferably the apparatus is adapted to perform interleaved printing. For example, the apparatus may operate to cause the printhead to discharge its nozzles at a rate that, given the angular and linear components of the motion of the object, causes ink to be deposited at spaced-apart points on a print grid.

Preferably the apparatus achieves interleaving in the direction of printing and/or the direction of the nozzle row of the printhead, for example in the helical direction (direction of printing) and parallel to the axis of rotation (the direction of the nozzle row in many examples). This can be achieved by each nozzle printing on fewer than every grid pitch. This can be achieved by, for example, speeding up the rotation of the part (keeping the firing rate of the nozzle constant).

Preferably the apparatus uses a number of printhead nozzles equal to KQ, where Q is a number which has no common factor with P, and where K is the number of interleaves in the printing direction. Other examples use more than one printhead to achieve the interleaving. The apparatus is preferably adapted to use more than one printhead Preferably the nozzle row of the printhead is angled with respect to the principal axis direction. Thus the coincidence of interleaved droplets can be avoided. Usually, the relevant angle will be small, typically a degree or less.

It may be the case where the resolution of a desired print grid exceeds the resolution of the printhead; that is, the printhead nozzles may be spaced further apart than the points on the print grid, that several passes are made by the printhead. For example, where the nozzles have a spacing that is P times the spacing between points on the grid in the direction of the principal axis, an image may be printed by making P passes over the printing area with a single printhead. Where more than one printhead is used in parallel (as shown in FIG. 2*a* described below), and the nozzles have a spacing that is P times the spacing between points on the grid, an image can be printed by making P/n passes over the printing area with n printheads.

It should be noted that a further advantage of inkjet printing onto essentially three-dimensional objects of the kind described is that a roughened, dimpled or corrugated surface can be printed, so long as the depth of such features is not such as to greatly reduce the quality of the resulting print due to increasing the distance from the nozzle. Another limitation is that the angle of the surface at any point, with respect to the nominal surface, has to be small enough such that differential ink deposition does not produce unacceptable visual effects due to a reduced angle of incidence, especially because the relative motion of the surface and printhead causes the droplets to approach the surface at an angle relative to the object. In some cases, with steep angles on surface textures, the result can be unacceptable. However, in some cases the result can be visually attractive and hence preferred.

Preferably the printing apparatus is adapted to carry out a first printing scan in a first direction and a second printing scan in a second direction. This feature may be provided independently. Preferably the second direction is substantially opposite the first direction. Preferably the two scans use the same printhead. By traversing one way for one print and back again for the next, cycle time can be reduced. For example, where an object can be printed in a single scan of a printhead, preferably the second printing scan prints on a different surface to that of the first scan.

The invention further provides a method of inkjet printing on a printing surface of a three-dimensional object using an inkjet printhead preferably having a plurality of nozzles, comprising effecting relative movement of an inkjet printhead and the object, during printing, with a rotational component about an axis of rotation and with a linear component, in which the linear component is at least partially in a direction substantially parallel with the axis of rotation.

Preferably the relative motion of the object and the printhead includes both linear and rotational components simultaneously. Preferably the relative movement produces a substantially helical printing path.

In some embodiments, the three-dimensional object has a printing surface that is curved in a first direction and substantially linear in a second direction. Preferably the rotational component follows the first direction of the printing surface.

In some embodiments the printed surface is at non-constant radius with respect to the axis of rotation of the rotational component.

In some embodiments the object has a principal axis, the axis of rotation being substantially parallel to or substantially coincident with the principal axis.

The linear component may be directed substantially parallel to the second direction of the printing surface. The linear motion may be substantially parallel to the axis of rotation, or may be angled with respect to the axis of rotation.

In some cases it is preferable for the printheads to be rotated about an axis parallel to the nozzle row as they are moved along the principal axis so that the printheads do not interfere with the printing surface, for example where the generator line is not in a plane containing the principal axis.

Where the object has a principal axis and a printing surface that is curved in a first direction and substantially linear in a second direction, preferably the rotational component is substantially parallel to the first direction and the linear component is substantially parallel to the second direction.

Where the nozzle pitch of the printhead is greater than the grid pitch to be printed onto the printing surface in the nozzle direction, preferably the method comprises printing substantially the full print grid in one scan of the printhead or printheads.

The method may comprise effecting relative motion of the printhead and the object, wherein the nozzle pitch of the printhead is greater than the grid pitch to be printed in the nozzle direction, and printing substantially the full print grid in one scan of the printhead or printheads.

The method may comprise using fewer than all of the nozzles of the printhead for printing, and preferably the number of nozzles N used is chosen for a printhead having nozzles at a pitch P times the desired pitch of the printing pattern, such that N and P have no common factors.

The method may comprise effecting relative movement of the printhead and the part in the direction of the nozzle row of L (N) for each revolution of the part relative to the printhead, where L is the pitch of the printing pattern in the direction of the nozzle row, and N is the total number of nozzles.

Where the method uses more than one nozzle row, the $M^{th}$ nozzle row may be offset by (M−1)/X times the nozzle pitch compared with the first nozzle row, where X is the number of nozzle rows.

Preferably the method comprises moving the printing surface relative to the printhead such that the relative linear velocity of a nozzle relative to the surface is substantially constant.

This feature is of particular importance and is provided independently. Thus an aspect of the invention provides a method of printing a three-dimensional object using an inkjet printhead preferably having a plurality of nozzles, comprising effecting relative movement of the printhead and the object, during printing, with a rotational component about an axis of rotation, in which the rotational component causes relative motion of the printing surface and a nozzle with a substantially constant linear velocity.

Where a plurality of nozzles in a nozzle row is used, preferably the relative linear velocity of the nozzle row relative to the surface is substantially constant. However, in some cases, for example where the part being printed is conical or a hyperbola of revolution, the actual relative velocity may vary along the length of the nozzle row.

The method may comprise rotating the object with a variable angular velocity with respect to the printhead.

The invention further provides a method of printing an image on a curved printing surface using an inkjet printhead preferably having a plurality of nozzles, the method including effecting relative movement of the printhead and the surface, and further including maintaining a substantially constant density of the image independent of the radius at the surface being printed.

Also provided is a method of controlling an ink jet printer including the step of controlling the density of the printed image dependent on the radius of the surface being printed.

Preferably the method includes varying one or more of:

(a) the speed of relative movement of the surface and a printhead;

(b) the spacing between ink droplets;

(c) the presence of an ink droplet at a grid point;

(d) the frequency of emission of droplets from the printhead; and (e) the size of an emitted ink droplet.

The invention also provides a method of processing an image to be printed by an inkjet printer, the method comprising changing the density of the image to be printed dependent on the radius of the surface to be printed.

In preferred methods, interleaved printing is effected.

The method may comprise interleaving in the direction of printing and/or the direction of the nozzle row of the printhead. In preferred examples, the method comprises using one or more printheads/nozzle rows, preferably using a number of nozzles equal to NK, where K is the number of interleaves in the printing direction, and N has no common factors with P, where the nozzles are at a pitch P times the desired pitch. Preferably, N is the number of nozzles used in each nozzle row.

The nozzle row of the printhead may be angled to the principal axis.

Preferably the method comprises carrying out a first printing scan in a first direction and a second printing scan in a second direction.

A preferred aspect of the invention provides printing apparatus for printing on a printing surface of a three-dimensional object, the apparatus comprising an inkjet printhead having a plurality of nozzles, and being operative to effect relative movement of the printhead and the object, during printing, with a rotational component about an axis of rotation and with a linear component, in which the linear component is at least partially in a direction substantially parallel with the axis of rotation and wherein the nozzle pitch of the printhead is greater than the grid pitch to be printed onto the printing surface in the nozzle row direction.

Preferably the printing apparatus is adapted to achieve interleaving in the direction of printing and/or the direction of the nozzle row of the printhead.

Preferably the apparatus is adapted to use a number of printhead nozzles equal to KN where K is the number of interleaves in the printing direction and N has no common factor with P, the ratio of the nozzle pitch to the print pitch in the nozzle row direction.

A further preferred aspect of the invention provides a printing apparatus for printing on a printing surface of a three-dimensional object, the apparatus comprising an inkjet printhead having a plurality of nozzles, and being operative to effect relative movement of the printhead and the object during printing with a rotational component about an axis of rotation and with a linear component, wherein the apparatus is adapted to perform interleaved printing.

A further aspect of the invention provides a method of inkjet printing on a printing surface of a three-dimensional object using an inkjet printhead having a plurality of nozzles, comprising effecting relative movement of the printhead and the object, during printing, with a rotational component about an axis of rotation and with a linear component, in which the linear component is at least partially in a direction substantially parallel with the axis of rotation, wherein the nozzle pitch of the printhead is greater than the grid pitch to be printed onto the printing surface in the nozzle direction.

Preferably the method comprises using a number of printhead nozzles equal to KN, where K is the number of interleaves in the printing direction and N has no common factor with P, the ratio of the nozzle pitch to the print pitch in the nozzle row direction.

The invention further provides a method of printing on a printing surface of a three-dimensional object using an inkjet printhead having a plurality of nozzles, the method comprising effecting relative movement of the printhead and the object during printing with a rotational component about an axis of rotation and with a linear component, the printing comprising interleaved printing.

Preferably the method comprises carrying out a first pass of the printhead, in which ink is printed at fewer than all of the points on a print grid of the pass, the method further including printing ink on unprinted points in a subsequent pass.

The invention further provides a printed object, printed by a method described herein.

The invention further provides a control device for a printer described herein.

The control device may control one or more parts of the printer, for example the movement of the object, the printhead and/or the timing of the firing of the nozzles to achieve the desired print pattern.

The invention further provides an image processor for analyzing an image to be printed and determining print sequence instructions for use in any of the printing methods described herein.

The invention also provides a method of determing print sequence instructions for a printing method described herein, including analyzing an image to be printed and determining the instructions.

The invention also provides a computer program and a computer program product for carrying out any of the methods described herein, and a computer readable medium having stored thereon a program for carrying out any of the methods described herein.

The invention also provides a method substantially as described herein with reference to the accompanying drawings, and apparatus substantially as described herein with reference to and as illustrated in the accompanying drawings.

Each feature disclosed in the description, and (where appropriate) the claims and drawings may be provided independently or in any appropriate combination.

Apparatus features may be applied to the method features and vice versa. Features of one aspect of the invention may be applied to other aspects of the invention. The invention further provides an apparatus for carrying out any method described herein and also provides a method of printing using any apparatus described herein.

The invention also provides a computer program and a computer program product for carrying out any of the methods described herein and/or for embodying any of the apparatus features described herein, and a computer readable medium having stored thereon a program for carrying out any of the methods described herein and/or for embodying any of the apparatus features described herein.

The invention also provides a signal embodying a computer program for carrying out any of the methods described herein and/or for embodying any of the apparatus features described herein, a method of transmitting such a signal, and a computer product having an operating system which supports a computer program for carrying out any of the methods described herein and/or for embodying any of the apparatus features described herein.

In any or all of the aforementioned, certain features of the present invention have been implemented using computer software. However, it will of course be clear to the skilled man that any of these features may be implemented using hardware or a combination of hardware and software. Furthermore, it will be readily understood that the functions performed by the hardware, the computer software, and such like are performed on or using electrical and like signals.

Features which relate to the storage of information may be implemented by suitable memory locations or stores. Features which relate to the processing of information may be implemented by a suitable processor or control means, either in software or in hardware or in a combination of the two.

In any or all of the aforementioned, the invention may be embodied in any, some or all of the following forms: it may be embodied in a method of operating a computer system; it may be embodied in the computer system itself; it may be embodied in a computer system when programmed with or adapted or arranged to execute the method of operating that system; and/or it may be embodied in a computer-readable storage medium having a program recorded thereon which is adapted to operate according to the method of operating the system.

As used herein throughout the term "computer system" may be interchanged for "computer", "system", "equipment", "apparatus", "machine" and like terms.

Embodiments of the invention will now be described in detail, by way of example, and with reference to the accompanying drawings, in which:

FIGS. 1*a* and 1*b* are, respectively, end and side schematic views of printing apparatus embodying the invention;

FIGS. 2*a* and 2*b* illustrate alternative arrangements of print nozzles in print heads of apparatus embodying the invention;

Figure 1A:
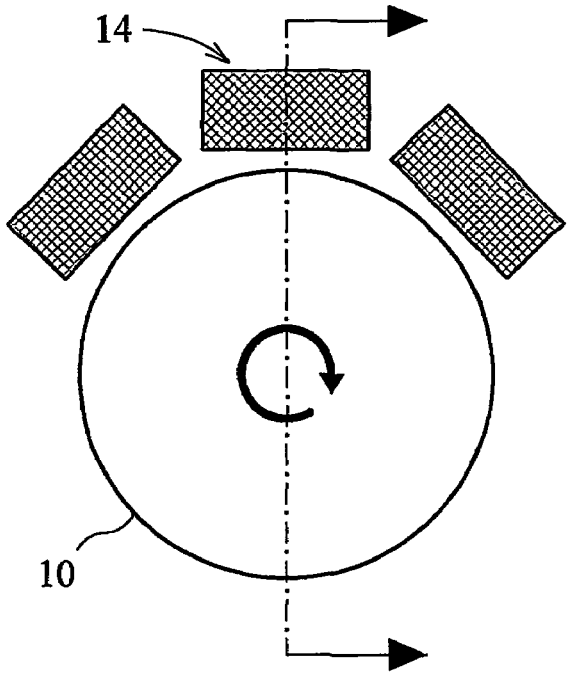
Figure 1B:
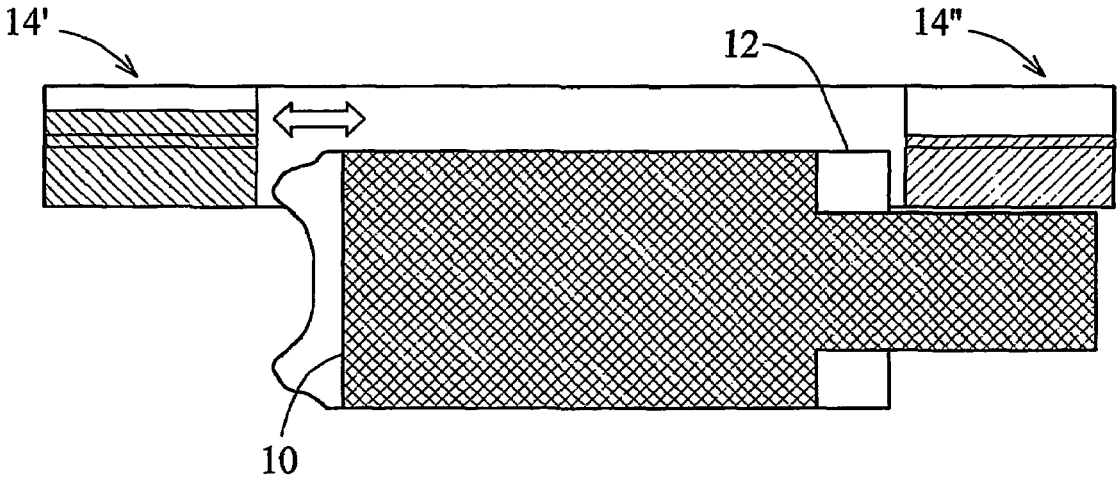

With reference first to FIGS. 1*a* to 1*b*, apparatus embodying the invention comprises a mandrel 10 for carrying an object, for example, a can 12, that has a print surface upon which an image is to be printed. In this case, the print surface is the outer surface of a cylinder that is centered upon a principal axis of the can 12 and of the mandrel 10. Therefore, it may be considered that the printing surface has a principal axis that extends along the length of the can and a generator line, parallel to the principal axis, that defines the surface by rotation at a constant radius around the principal axis.

The mandrel 10 is carried upon the handling apparatus (which is not shown) that is operative to move a can into position for printing at a printing station in a direction that is substantially horizontal in FIG. 1*a*.

At the printing station, there are printheads 14 (in this embodiment, three in total). The printheads 14 are arranged in part of a circular locus that extends around an axis that is coincident with the principal axis of the can when in position at the printing station. At the printing station, the mandrel 10 (and the can 12 carried upon it) is capable of rotation about the principal axis while the printheads 14 can be moved linearly along a line that is parallel to the principal axis between two opposite extremes of travel, as shown at 14' and 14" in FIG. 1*b*. The mandrel 10 is cut back to allow it to index horizontally when the printheads 14 are at the end of their travel in either direction.

In a first embodiment of the invention, the printheads 14 are driven parallel to the generator line of the cylindrical printing surface at a constant speed while the can is rotated about an axis of rotation at a constant angular speed. Printing is continuous until the entire printed surface is printed, normally in one pass, but optionally in several passes, and the printheads 14 complete their travel to the position shown at 14" is reached. Thus, each nozzle of each printhead 14 produces a helical path of ink dots on the printing surface (although, as indicated below, fewer than all of the nozzles of the printhead might be used). In this embodiment, printing may or not be carried out with an interleave in the helix direction (see below).

After printing, the can may then be indexed on to a further processing station by the handling mechanism.

It is advantageous for the next printing cycle to take place in reverse so that time is not wasted by returning the printheads 14 to their start position.

In this, as with many, embodiments, the required pattern of printing has a grid pitch which is less than that of the nozzles of each printhead 14. For instance, the print pattern may be specified to place ink dots in a grid with a resolution of 600 lines of print per inch (dpi) in the direction of the nozzle array, while the nozzles may be spaced at only (for instance) 100 per inch. The ratio of the grid resolution to the nozzle spacing will be denoted as P which will normally be an integer. In general, the helices formed by adjacent nozzles will have P−1 helices between them (where the nozzles are at P times the desired print pitch in the direction of the principal axis). The print pattern can be said to have an interleave of P in the axial direction the object. In this example, P=6.

In order that a continuous, regular grid pattern is printed onto the printing surface of the cylindrical part, the number of helical tracks on the object (and, therefore, the number of nozzles used where there is no interleaving) must be a number N such that N and P have no common factor. If, for instance, a single printhead 14 were to be used (rather than the three shown in FIG. 1), with 256 working nozzles, the maximum number of continuous nozzles that could actually be used is 253 (because 256 and 254 are divisible by 2 and 255 is divisible by 3). To ensure that the print pattern is complete, P and N have no common factors. The printing pattern will be in the form of N helices on the surface of the can. The printhead 14 must be advanced by a distance in the direction of the nozzle row of LN per revolution of the object, where L is the pitch of the printing pattern in the direction of the nozzle row.

If more than one printhead 14 or one or more print heads with more than one nozzle row is used there are different ways in which the nozzle rows may be arranged.

Figure 2A:
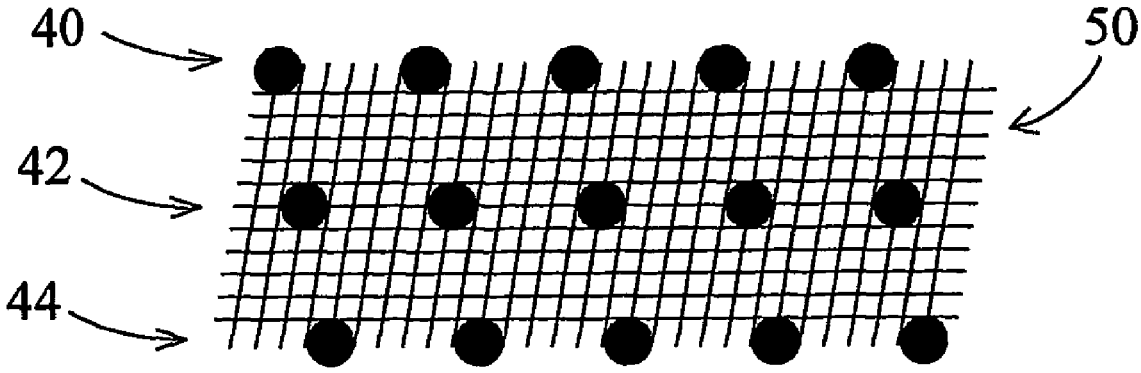

In a first arrangement, the printheads 14 are said to be arranged in parallel as shown in FIG. 2*a*. The figure shows part of the three nozzle rows 40, 42, 44 of three printheads, against a developed view of the print grid 50. The three nozzle rows (assumed, to be linear arrays for simplicity) are shown each offset by two grid pitches. The print grid shown is angled from vertical (the direction of rotation) according to the helix angle. In fact, the nozzle rows are offset by 6K+2 pitches with respect to the grid, where K is an integer. Note that 2 is P divided by the number of printheads (3 here) and must be an integer in this example. K is normally zero. The effect is that the three printheads 14 can be considered to be equivalent to a single printhead with three times the number of nozzles at one-third the nozzle pitch, as compared with each of the printheads 14 of this embodiment. Clearly, when the apparatus is in operation, a control system, including image processing, must allow for the fact that there is an offset in placement of the nozzles of the printheads 14 which requires a delay in the section of the entire image which is presented to the "lagging" printheads.

The helix angle from the rotation direction is given by $\tan^{-1}$ (LN/K/S) where L is the pitch of the printing pattern in the direction of the nozzle row, N is the total number of nozzles, K is the number of interleaves in the helix direction and S is the circumference of the object to be printed at that point.

If three printheads are provided, each having 256 nozzles, that are already arranged in parallel as shown in FIGS. 1 and 2*a*, it is possible to use a maximum of 767 (which has no common factor with 2) nozzles, assuming that the printhead nozzles are spaced regularly with respect to each other. This is, in effect, the criterion above for a single printhead, but setting P=2 (i.e. 6÷3), and a total nozzle count of 768 (i.e. 256×3) with no interleaving in the helix direction. The advantages of interleaving in the direction of the print direction (here helix direction) include the reduction of the visual impact of "line" defects which can be caused by misaligned nozzles.

Figure 2B:
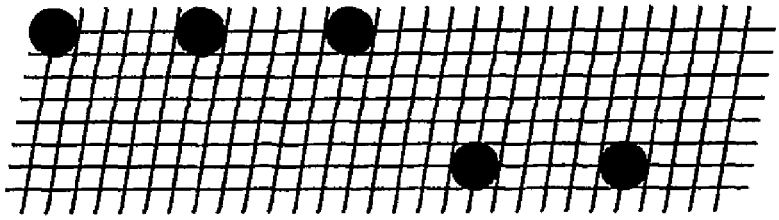

The second arrangement of the printheads is that the multiple printheads are arranged, so-called, in series, as shown in FIG. 2*b*. In this case, the end of the nozzle array of one printhead (shown here as a linear array for simplicity) and the start of the nozzle array of an adjacent printhead produce a continuous print grid when operated. Control of the apparatus and the image processing in particular must, as before, account for the delay required to print a single image.

Figure 3:
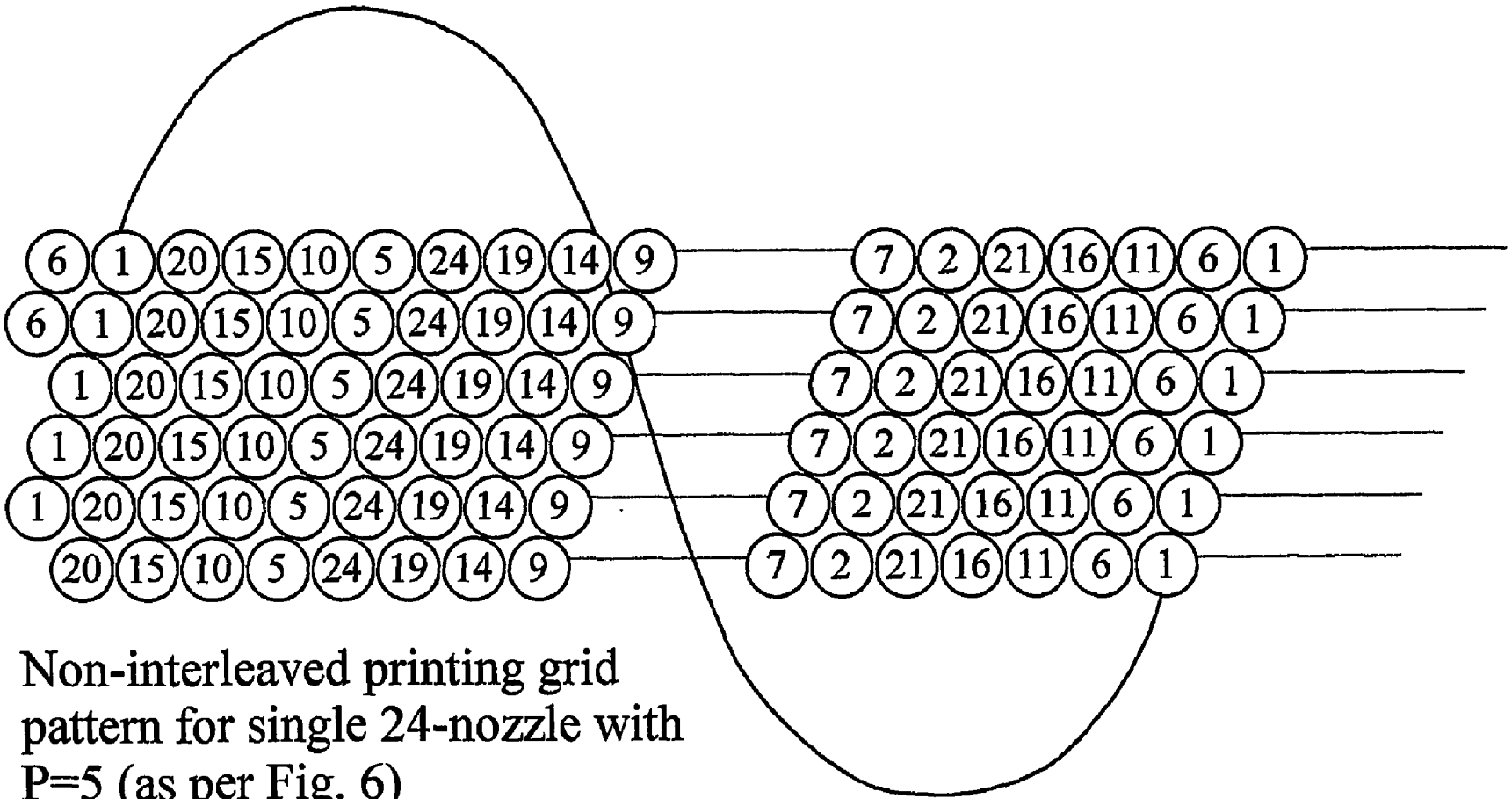
FIG. 3 illustrates the order in which ink dots are deposited in a first arrangement.

FIG. 3 illustrates part of the pattern of dots laid down a complete pass by a 24 nozzle printhead (N=24, P=5) over the substrate, the dots on the cylindrical printing surface being mapped onto a flat grid in the figure. On the first pass, nozzles 1 to 24 of the printhead each lays down a helical track of dots. The number contained in each dot in FIG. 3 identifies which nozzle produced it. Since the nozzle pitch is five times the grid pitch (i.e. P=5) the dots produced by adjacent nozzles are spaced at a spacing of five grid points.

In another embodiment of the invention, the object can be rotated at a higher speed in order to interleave the printing along a helical path. For example, for an interleave of 2, the object is rotated at twice the speed that would produce a solid fill, and during a traverse pass of the printhead(s) (at the same transverse speed), each helical line is printed twice. This can be done using the same basic print pattern, but with each helical path being passed over by two printheads. In this case, the number of nozzles used has to be such that 2N nozzles are used, where N has no common factor with P.

Figure 4:
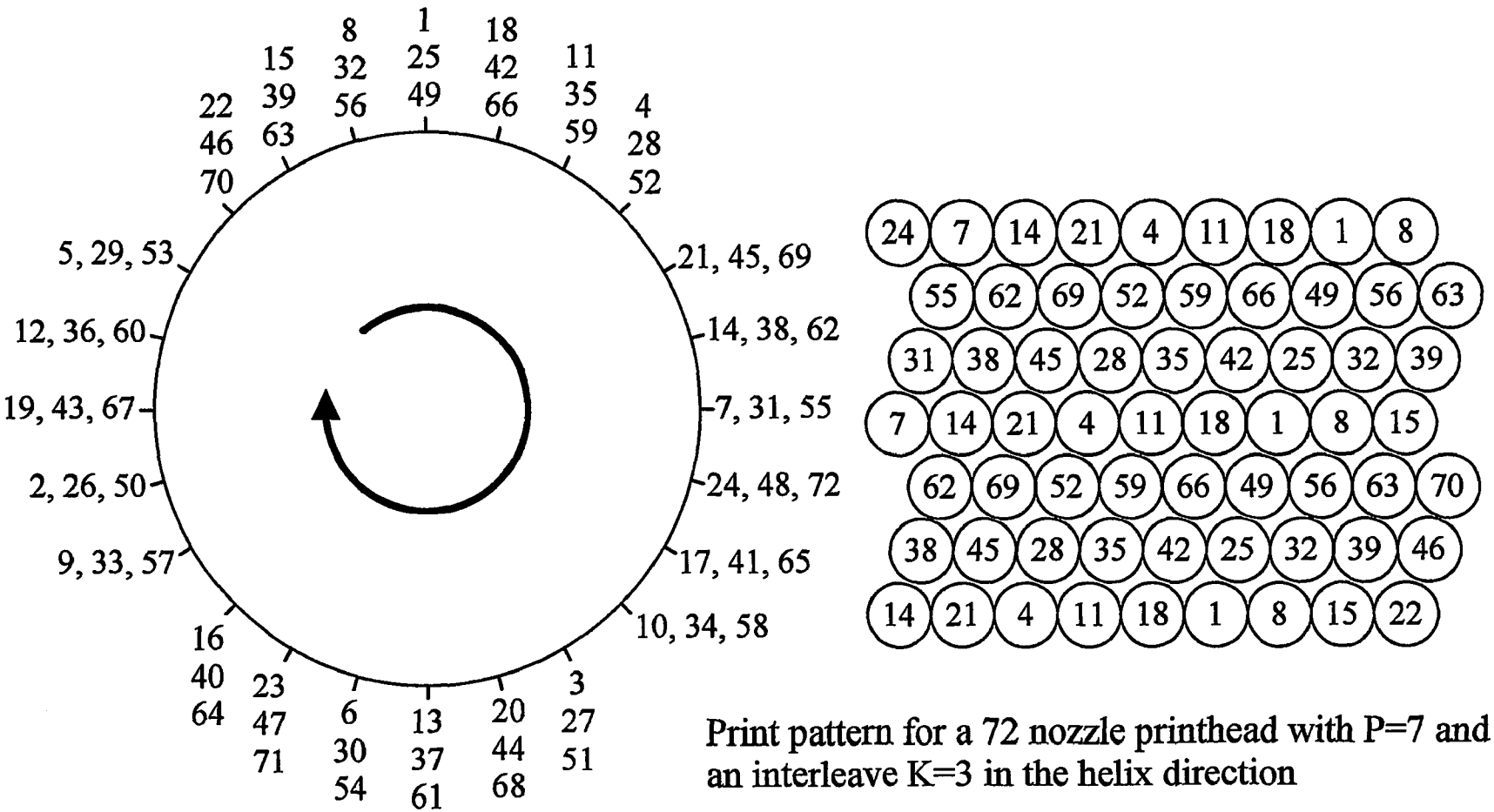
FIG. 4 illustrates a second, interleaved, arrangement of print dots.

FIG. 4 shows a sample print pattern for a 72 nozzle printhead using an interleave of 3. In this arrangement, N=24, P=7 and K=3, so that the total number of nozzles is KN=72.

The circle in FIG. 4 is a schematic representation of an end view of a rotating cylinder being printed. The numbers around the circumference illustrate the position at which those nozzles print the start of their helices at the end of the object.

It can be seen that interleaves of two or more can be achieved in a similar way from a single printhead, or more than one printhead, using a number of nozzles equal to KN where K is the number of helix-direction interleaves.

In order that the second and third interleaves produce drops which do not lie directly on top of the first set, it is preferred to angle the printhead away from the generator line such that the second set of drops is displaced by one grid pitch in the helix direction. For an interleave of 2, the correct angle would be one print grid pitch in the direction of rotation over N nozzle pitches. FIG. 4 shows the print grid resulting from such a method. For an interleave of K in the helix direction, the nozzles have to be angled at one pitch in the helix direction for each N nozzle pitches.

In a preferred example, the image is created with blank data except for every Kth grid position in the helical direction, and print is laid down at K times the nominal droplet firing rate of the nozzles. This method will produce a satisfactory interleave, but will only be possible without sacrificing print speed if data can be loaded into the printheads at a rate K times the maximum rate of firing of the nozzles. The object is rotated at K times the speed that it would be for K=1 (i.e. no helix direction interleaving as in FIG. 3).

Other ways to interleave are also possible. For instance, it would be possible simply to use a nozzle-direction print grid which has (say) half the pitch of the nominal grid, and to print at twice the nominal helix-direction pitch. The number of nozzles required from a single printhead would then be such that N has no common factor with P, where P−1 is, as before, the total number of helices between two helices produced by adjacent nozzles. More than one printhead can still be used by using the methods described above.

Other ruled surfaces described above can be treated as extensions to this method, driving the printheads always in a direction along the generator line and with the nozzle array aligned with that direction. Some additional factors do however have to be taken into account.

For surfaces generated by the rotation of a line in the plane of the principal axis but at an angle to it (a conical surface is a special case when the radius of rotation is constant), the main complication arises because the grid pitch at any point in the helix direction will depend on the radius of the surface at that point. If the rotation is at constant angular velocity and the nozzle firing rate remains constant, the grid pitch is proportional to the radius of the surface at that point. The image processing ensures that the laydown of ink is adjusted so that any single colour is rendered at the same effective ink density regardless of the radius. This could, for instance, be done by taking a normally prepared electronic image and "screening" the image by overlaying a map of colour intensity which reduces the colour intensity proportionately at less than the maximum radius. It is important that the nominal print grid is laid down at the maximum radius, so that the packing of the grid can be reduced at smaller radii in order to compensate for a denser print grid in the helical direction.

A further possible method of maintaining print density is to increase the angular velocity of the object as the nozzle row traverses to smaller radii. If the nozzle firing is enslaved to an encoder, the signal from the encoder would be adjusted to reduce it in frequency as the printhead traverses to smaller radii and to increase it in frequency as the printhead traverses to larger radii.

Figure 5:
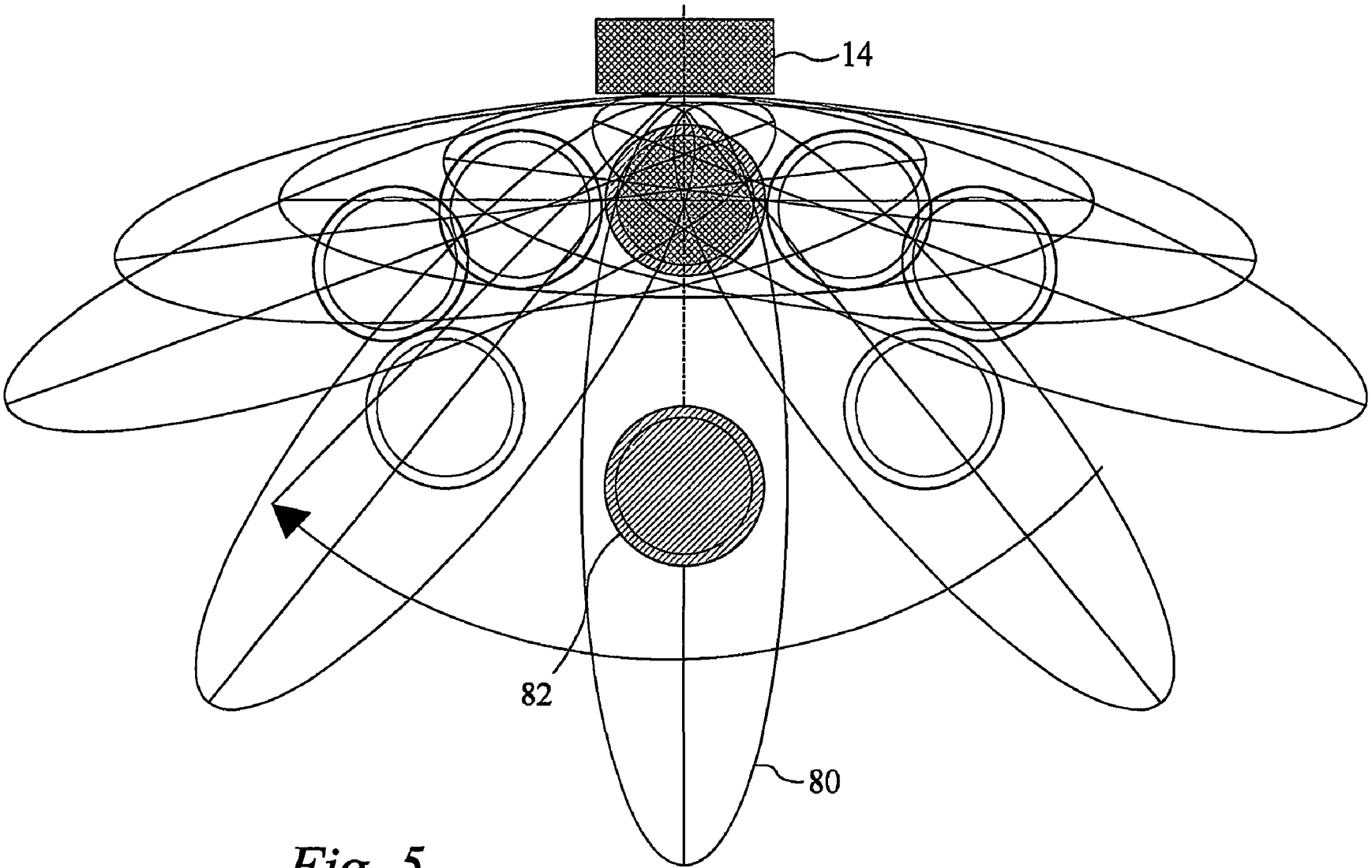
FIG. 5 illustrates apparatus embodying the invention printing onto a printing surface that has a non-constant radius of curvature.

A different set of problems is encountered when it is wished to print onto a ruled surface that is generated by lines in the plane of the principal axis, but which change radius during rotation. Such surfaces are typical of many plastic bottles, and a top view of such a bottle 80 is shown in FIG. 5. Here for simplicity we can assume that the generator line is parallel to the principal axis which runs through the centre of the open neck 82 of the bottle.

Ideally, for image quality, only one nozzle row would be used situated so that the surface is parallel to the nozzle plate at all times. Such a situation is shown in FIG. 5. However, it may be that a higher throughput is needed and more than one nozzle row is used, for example in the arrangement shown in FIGS. 1*a* and 1*b*.

In this case, there will be an optimum angle to set multiple printheads, such that:

at the tightest radius of the substrate (the furthest from the principal axis for the example shown in FIG. 5), the nozzle rows are still close enough to the substrate to provide good quality printing; and at the largest radius of the substrate (the nearest to the principal axis for the bottle shown in FIG. 5) the edges of the nozzle plates do not touch the bottle surface.

The arrangement of the printhead(s) may be chosen to be suitable for printing a range of substrates, for example a range of bottles, based on the "worst case" geometry of the bottles. Alternatively, the arrangement of the printhead(s) may be optimized for each bottle shape.

As shown in FIG. 5, the nozzle array 14 (seen edge-on in FIG. 5) must always jet in a direction which is essentially normal to the surface at that point, otherwise the edges of the nozzle plate may clash with the surface. In order to achieve this condition, the relative positions of the printhead 14 and the bottle 80 must be adjusted as shown in FIG. 5, where the centre of rotation is moved as the bottle 80 rotates. Note that, whereas FIG. 5 shows the object moving relative to a stationary printhead, it may be possible to move the printhead 14 in at least one axis while the bottle 80 rotates, for instance the printhead 14 could move vertically, allowing the centre of rotation of the object to move only in the horizontal axis.

It can also be seen in FIG. 5 that if the part is rotated at a constant angular velocity, the relative surface speed of the part will vary during the rotation. This could be corrected using a similar method described above for conical surfaces, but it is also possible to vary the angular velocity of the bottle 80 during its rotation such that a constant linear surface velocity is maintained. Note that such a method can be made to correct completely for surface speed variations in the case of a bottle 80 as shown in FIG. 5, whose generator line is parallel to the principal axis. If, however, the line is angled with respect to the generator axis, then at least some correction must be made using the methods described above for conical surfaces.

It may be that one colour is printed at one printing station, but more than one colour can be printed if desired (for instance in the embodiment shown in FIGS. 1*a* and 1*b*, three colours out of a six colour set could be printed at the station shown, and the three remaining colours at another station).

It may also be advantageous for some kind of surface treatment to be carried out at a previous station, for instance flaming of a plastic object in order to improve ink adhesion.

Fixing of the print, for instance by drying of a solvent ink or curing of a UV curing ink, could take place below the object when the printheads are placed above the object, or could take place at the next station.

Figure 6:
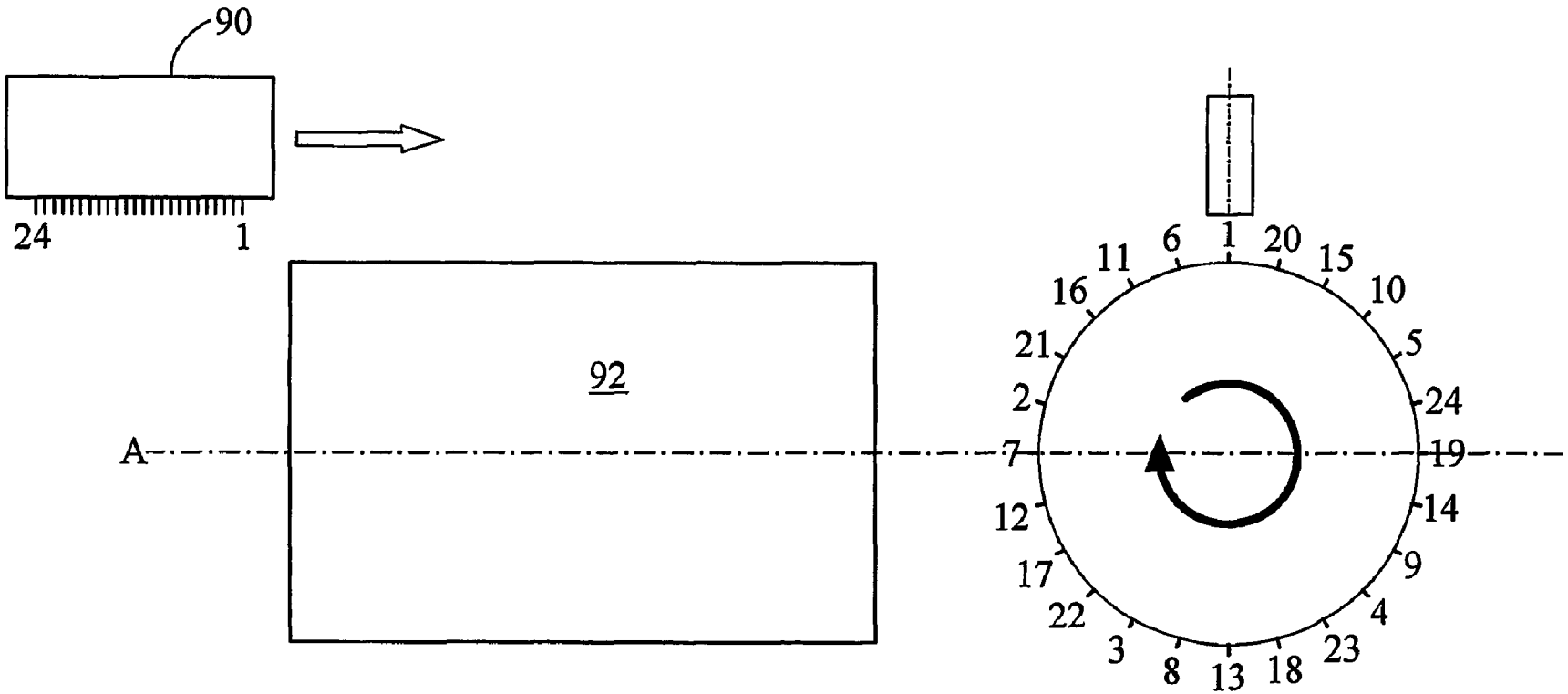
FIGS. 6 and 7 are diagrams to illustrate the order in which ink dot tracks are formed on a printed surface in embodiments of the invention.

With reference now to FIG. 6, a simplified embodiment will be described, that makes use of a printhead 90 with just 24 nozzles and a cylindrical printing surface. As shown in the figure, the nozzles in the printhead 90 are numbered from 1 to 24 and are arranged in a straight row. The nozzles are at 5 times the desired print pitch in the direction of the principal axis. There is no interleaving along the helix. In the axial direction, printing is interleaved by a value of 5.

The printing surface is formed on the outside of a cylindrical body 92, and is centered upon a principal axis A. During printing, the body is rotated about the principal axis A at a constant rate, and the print head moves axially, parallel to the principal axis A such that the nozzles pass close to the printing surface. The row of nozzles is parallel with the principal axis A.

The numbers on the end view represent the start point of the helices associated with each nozzle. It can be seen that the printhead advances by one nozzle pitch every 5/24 of a revolution (ie P/N).

As printing starts, nozzle 1 starts to print at an end of the printing surface. It crosses a plane that defines the end of the printing surface at a point indicated at 1 (the starting position) in the figure. Movement of the object continues such that nozzle 1 starts to create a helical track on the printing surface. Eventually the print head will have advanced sufficiently far that nozzle 2 begins to print onto the printing surface at a point indicated at 2.

As printing continues, by the time that nozzle 6 starts to print its track, the body has rotated from the starting position by one complete revolution plus the width of one track in the printing grid.

By continuing this process, the entire printing surface is covered at the grid resolution in one pass.

Figure 7:
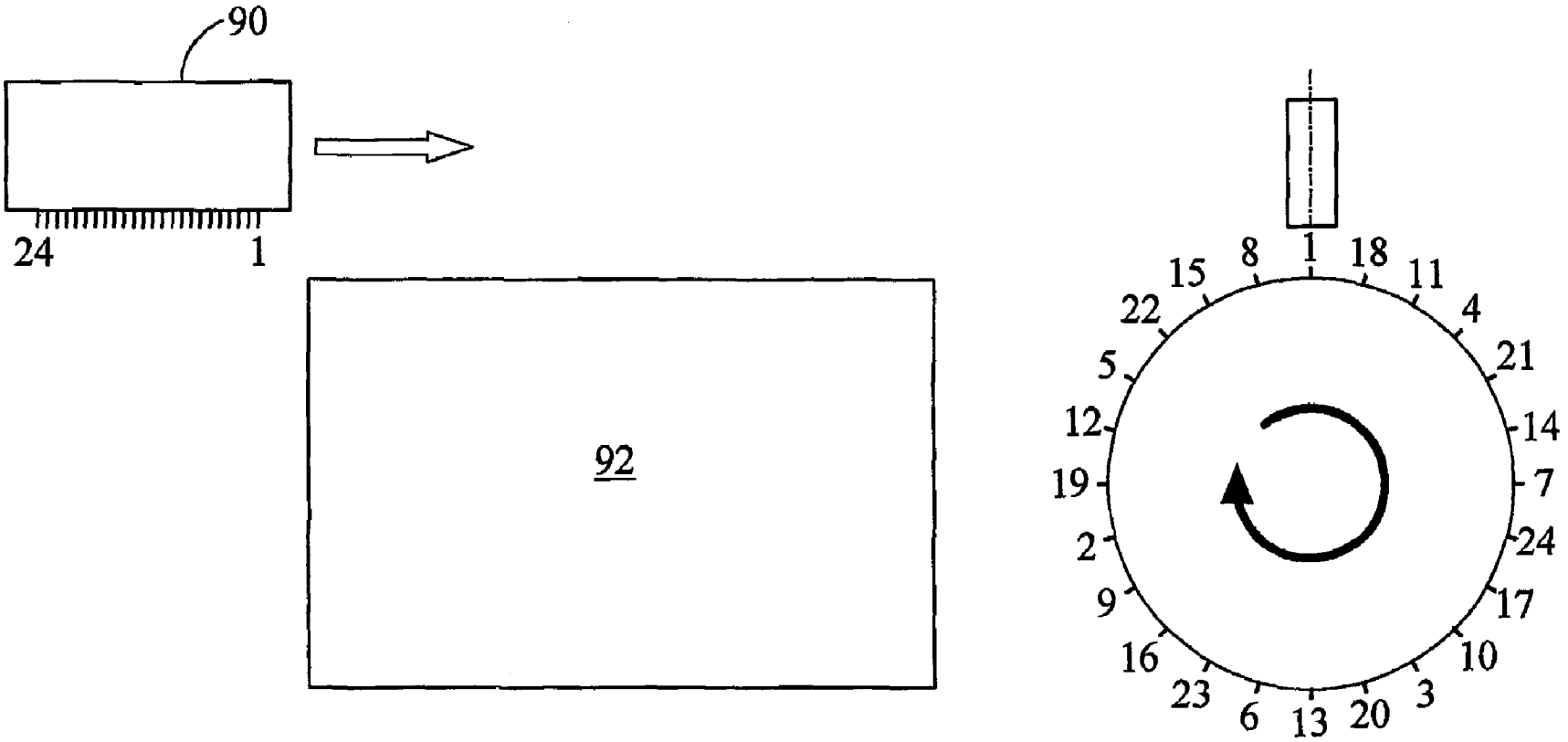

FIG. 7 shows the same apparatus as that shown in FIG. 6 implementing an interleave of 7 in the linear direction without any interleave in the helical direction. Operation can be considered to be similar to that of FIG. 6. It will be seen that the printhead must advance by one nozzle pitch every 7/24 of a revolution. The printing surface is still covered in one pass.

If an interleave is required in the direction of the helix (a good way to reduce the visual effect of nozzle defects and hence to improve visual quality) the formula changes. FIG. 4 is intended to illustrate how this might work in practice.

If the printhead described with reference to FIGS. 6 and 7 had 48 nozzles instead of 24, then the second set of nozzles would retrace the helices of the first set of 24. So nozzle 25 would print onto the same helix as nozzle 1, and so forth. In general, for an interleave of K in the helix direction, it is convenient to use a number of nozzles K.N, where N has no common factor with P. That will ensure that K nozzles trace over the each helix.

The issue then is to ensure that a regular pattern is achieved in the helix direction. As an example, assume that 72 nozzles are used to print a pattern with P=7 using an interleave of 3. FIG. 4 shows a section of the pattern resulting from an interleave of 3 using a 72-nozzle printhead with P=7. The angle of the helix is a result of moving the entire print pattern by $1/K^{th}$ of the length of the nozzle array while P complete circumferences of the part are printed (i.e. P rotations).

The problem is then to ensure that (for instance) the droplets from nozzle 7, 31 and 55 are equally spaced along the helix. If the printhead 90 were aligned exactly with the principal axis, and the same firing stroke were used for all nozzles, the droplets would nominally lie on top of each other. Two possible ways to ensure even distribution as follows:

Angle the nozzle array such that every ($N^{th}$) nozzle is displaced by the correct amount (roughly one pitch) in the rotational direction. This angle is typically small, and the cosine of the angle is therefore near enough to unity that the droplets are still placed in the correct place in the direction of the principal axis.

Provide print signals at K times the frequency at which any single nozzle is fired; For the example above, nozzles 1-24, 25-48, 49-72 would be fired in three alternate groups. This method is suitable for printheads for which the maximum nozzle-firing rate is much less than the maximum rate at which data can be read in to the printhead.

Control System/Image Processing

What follows is a description of methods of formatting image data for printing non-cylindrical 3D objects.

In summary, the formatting for the following method described includes the following steps:

1) take the image, for example in the form of a vector image file or bitmap file;
2) adjust the shape of the image depending upon the shape of the object upon which the image is to be printed, for example by cropping the image or compressing regions of the image;
3) stretch the grid back to the original size of the grid in (1), retaining the original number of 'drops' sites, inserting zeros or blank sites to effect the stretching;
4) adjust the format of the image, if necessary; for example if the image is in vector format, convert to bitmap format; and preferably subsequently
5) perform rastering for the helical scan as for a cylindrical object.

Figure 8A:
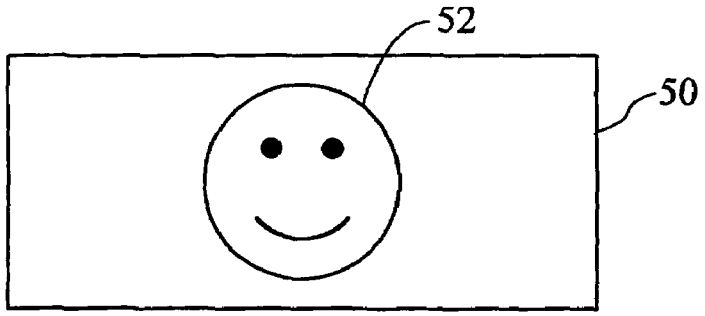
FIG. 8 is a diagram which illustrates the method in which an image is processed in order to print onto a conical, or other quasi-cylindrical object.
Figure 8B:
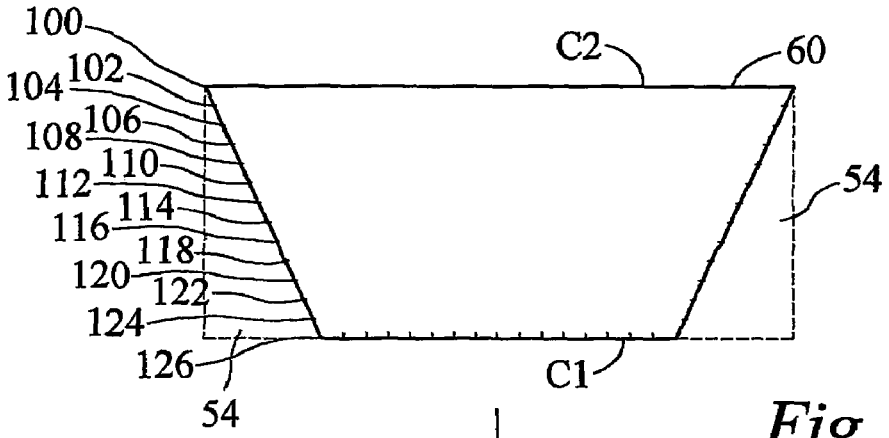
Figure 8C:
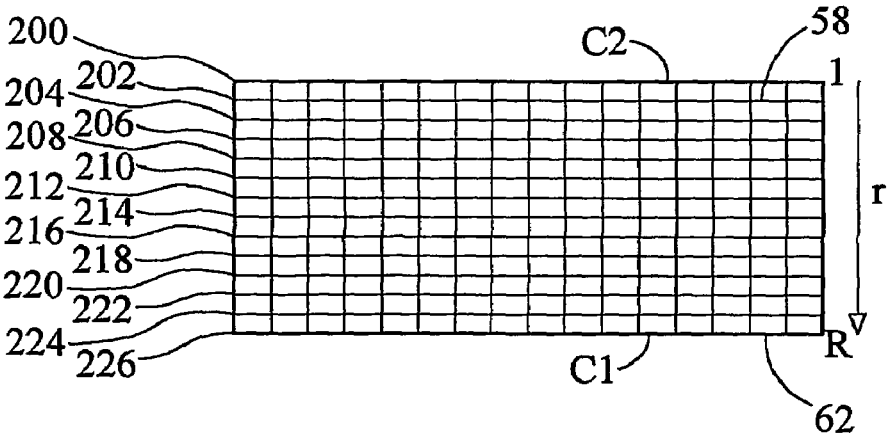

For example, and referring to FIGS. 8*a* to *c*, to print a conical surface (for example a yoghurt pot) using a multiple nozzle printhead whilst maintaining acceptably consistent saturation and print resolution on the surface, the following method may be used:

Referring now to FIG. 8(*a*) an image to be printed 52 is shown on a rectangular bitmap 50. This image is the output of a Raster Image Processor (RIP) and is in, for example, Hewlett Packard Raster Transfer Language (HP-RTL) format. The image and background will usually be in the format of a bitmap image.

The formatting of the image to render it suitable for printing on the yogurt pot includes the following steps:

1) Referring now to FIG. 8(*a*), take the output of the of the (RIP) in the form of a rectangular bitmap 50.
2) Referring now to FIG. 8(*b*) (the image 52 is not shown for the sake of clarity), the bitmap is cropped (in other examples it could be adjusted in a different way), into an inverted trapezium 60 (bottom side shorter than top) such that portions 54 are removed from the image. The top side C2 remains the same length as the original rectangle. The bottom side has a length C1 equal to the smallest printed circumference. Also, the bitmap is sized such that the first (top) line contains a number of pixels equal to the desired print resolution multiplied by the largest printed circumference of the surface.
3) Referring now to FIG. 8(*c*) the trapezium 60 is stretched back to a rectangle 62 which is the same size as the original bitmap rectangle 50. Therefore, the bottom of the trapezium C1 is resized to the bottom of the rectangle 50. This stretching resizes the bitmap image 52 (again not shown for clarity) in accordance with the amount of stretching required and retains the original number of actual drops (set pixels) for each image row such that a new print grid 58 is formed.

In order to expand the bottom of the grid while retaining the same number of printed drops, "blank" grid points, where the nozzle does not fire, are inserted. This avoids the image becoming overly dense towards the bottom; certain grid points are selected to be unprinted. This process may be viewed as "inserting zeros" into the firing cycle of the printhead(s). This can be done as follows:

For each (descending) line, calculate the stretching factor F for a given row.

That is:

$$F=(r/R)\times(C2/C1)/C1$$

where r=current row, R=rows in image, C2=top circumference, C1=bottom circumference (unstretched value)

Generate the output rectangle by copying sequential pixels from the left edge of the trapezium to the left edge of the rectangle. (So that, points 100, 102, 104, . . . 126 are mapped to points 200, 202, 204, 206, . . . 226 respectively.)

Accumulate an error value e for each input column, using e+=F along the line

When e>1, decrement e and "insert a zero" to the output nozzle (ie. increment output column without incrementing input column)

Reset the error value to 0 before beginning every row.

4) Perform rastering for the helical scan as for cylindrical objects.

Alternatively, in step 2 , the rectangle of step 1 is squashed (for example using an existing Photoshop plug-in) to form the trapezium and then step 3 is carried out.

This method will also work with bitmaps formatted for greyscale printheads.

Further Image Processing Methods—Correcting Image Density

In the case of a yoghurt pot having a substantially conical shape, as described above, in some cases the printed image may become denser nearer the bottom of the pot as the radius decreases and the printed droplets are closer together. Therefore, the image density, or brightness, would, unless corrected otherwise, be greater at the bottom of the pot. The following methods may be used to reduce this image density.

This method may be provided additionally, or as an alternative to the method described above.

Cyan-Magenta-Yellow-Black (CMYK) is a colour model in which all colours are created from a mixture of these four process colours. CMYK is used in a number of printing techniques. In contrast, display devices generally use a different colour model called RGB, which stands for Red-Green-Blue.

A Raster Image Processor (RIP) (which may be embodied as a software application or as a software/hardware combination) performs a number of successive operations to generate a print image. These usually include:

Conversion of image to a Postscript, or other page description language (PDL) file;

Transformation, through an interpreter, of the PDL format into a 24 bit RGB domain;

conversion to a 32 bit CMYK domain; and screening/dither to a 4 bit or other reduced bit CMYK domain.

Of the three possible domains named above in which adjustment of the print density would be possible, it is leasteffectively done in the 24 bit RGB domain as there is a non-linear relationship to the final image density.

It has been found that this adjustment might best be performed on the print image whilst it is in 32 bit CMYK form. Adjustment in the reduced (for example 4 bit) CMYK format is also possible, but not ideal as this model contains only 1 bit of information per colour. The application of any density transform in this domain may add significant "noise" patterns to the print.

What follows is a description of two preferred methods of correcting the image density (that is, brightness) of an image which is to be printed on a conical, (or other like) surface.

Method 1: Correct the Image Density in CYMK 32-bit Form

The image density will be corrected by applying a density gain factor g to the saturation value of the process colours in the CMYK model. That is, as the printheads move closer to the bottom of the yogurt pot, the density gain factor (<1) is applied to the eight bits per colour per pixel to reduce the amount of ink for each of those four colours being printed on the substrate in order to correct the image density as described above.

The algorithm for correcting the density in the 32 bit CMYK domain is now described. The density gain factor g depends on the ratio of object's radius at the current print line r to the largest radius of the object being printed upon r1. That is:

$$g=r/r1.$$

Given that the image is usually presented as it will be viewed on the object (i.e. the radius varies in the vertical direction across the image) we can find a function f( ) which provides the instantaneous radius r at any height h on the object such that r is a function of height, that is:

$$r=f(h)$$

Hence we can combine these two formulae: g=f(h)/r1.

The height corresponds to the image row counting in the opposite direction (that is from top to bottom—the widest part to the narrowest part). So, provided the function f is known as a proportion to the largest radius (f'( )), the corrected image density can be applied by multiplying each row of pixels by the appropriate gain factor; the density gain factor being given by:

$$g=f'(\text{row\#})$$

For example, in the case of a non-cylindrical object such as a yogurt pot, where the first image row has the largest radius r1, and that of the last image row has the smallest radius, r2, then the function f'( ) resolves to:

$$f'(\text{row})=(r1-((r1-r2)*(\text{row}/\text{rows})))/r1$$

Where "row" is the current row, and "rows" is the total number of rows.

This further resolves to:

$$f'(\text{row})=1-((r1-r2)*(\text{row}/\text{rows}))/r1$$

This shows that, as the number of rows increases (that is, the printhead moves down the yogurt pot) the image density gain will decrease, thereby meaning that the saturation of each pixel is reduced.

Another quasi-cylindrical shape where the radius is constant for a particular height, will require only a new formula derived in a similar manner as above. The processing can be performed as outlined above.

Method 2: Correct the Image Density in CYMK 4-bit Form

This method does not, in some cases, produce images with the same quality as that of Method 1, but is easier to implement as it is not necessary to have access to the RIP internals. The 4-bit CMYK data is usually available in the form of BP-RTL (Hewlett Packard Raster Transfer Language) with one bit per colour of each pixel. Other print data formats can also be used, for example 12 bit CMYK for greyscale printheads. As with method 1, a function is derived to calculate the gain factor, f'( ).

However, instead of multiplying each row of pixels with this gain factor, an accumulation (a) of the difference from one of the gain factor of every pixel is made as an index is made across the row. That is, for each pixel:

$$a+=1-f'(\text{row})$$

When this accumulated gain difference exceeds one, the value for the current pixel (all 4 colours) is set to zero, and the accumulator decremented by one. Hence, when the end of the row is reached, a proportion of the pixels will be set to zero which will be equal to f'(row).

Unfortunately, this technique can generate coherent patterns in the image roughly every 1/(1−f'(row)) pixels. However, in order to compensate for this, a sorting algorithm can be applied to spread the positions of the pixels that have been set to zero and hence reduce the visibility of these patterns. For example, a pseudo-random sequence can be used to add or subtract 0.5/(1−f'(row)) from the accumulator (a) following every time it is decremented by one. Provided the proportion of pixels set to zero remains the same, the overall effect will be equivalent.

It will be understood that these methods could be implemented either in software in a software/hardware combination.

It will be understood that the present invention has been described above purely by way of example, and modifications of detail can be made within the scope of the invention.

The invention claimed is:

1. An inkjet printing apparatus for printing an image on a printing surface of a three-dimensional object located at a printing position, the apparatus being adapted to print the image on the printing surface by printing droplets at grid points of a print grid for the image, the grid points being spaced apart at a grid pitch, wherein the apparatus comprises:

a handling apparatus for supporting the object such that the object extends out from the handling apparatus into a printing region, wherein the handling apparatus is operable to move the object into and away from the printing region;

an inkjet printhead having a plurality of nozzles spaced apart at a nozzle pitch in a nozzle row direction, the printing apparatus being operative to effect relative movement of the printhead and the object, during printing, with a rotational component about an axis of rotation and with a linear component, in which the linear component is at least partially in a direction substantially parallel with the axis of rotation and wherein the nozzle pitch of the printhead is greater than the grid pitch of the image in the nozzle row direction; and wherein the printhead and the handing apparatus are operative to move with respect to each other and the handing apparatus is further operative to rotate the object with a variable angular velocity so that a printing surface of the object that is at non-constant radius with respect to the axis of rotation passes a nozzle of the printhead with a substantially constant linear velocity.

2. Printing apparatus according to claim 1 in which the relative movement produces a substantially helical printing path.

3. Printing apparatus according to claim 1, the apparatus being such that substantially all of the full print grid for the image can be printed in one scan of the printhead.

4. Printing apparatus according to claim 1, in which a number of nozzles N used for printing has no common factor with P, other than 1, for a printhead having nozzles at a pitch P times the grid pitch.

5. Printing apparatus according to claim 4, in which the relative movement of the printhead and the object in the nozzle row direction is LN for each revolution of the object relative to the printhead, where L is the grid pitch in the direction of the nozzle row.

6. Printing apparatus according to claim 1 comprising more than one nozzle row, the nozzle rows being offset.

7. Printing apparatus according to claim 1 operative to perform interleaved printing in the direction of printing.

8. Printing apparatus according to claim 7, wherein the apparatus is adapted to use a number of printhead nozzles equal to Kn, where n is a number of printing paths to be printed in the direction of printing, and where K is the number of different nozzles used to print each print path in the printing direction and n has no common factor with P, other than 1, the ratio of the nozzle pitch to a grid pitch in the nozzle row direction of an image to be printed.

9. Printing apparatus according to claim 1 wherein the apparatus is adapted such that in a first pass of the printhead, ink is printed at fewer than all of the points on a print grid of the pass, the apparatus being adapted to print ink on unprinted grid points in a subsequent pass.

10. Printing apparatus according to claim 1, wherein the nozzle row of the printhead is angled to the principal axis of the object.

11. Printing apparatus according to claim 1 in which the printing surface is at non-constant radius with respect to the axis of rotation.

12. A method of inkjet printing an image on a printing surface of a three-dimensional object using an inkjet printhead having a plurality of nozzles spaced apart at a nozzle pitch in a nozzle row direction, comprising the steps of:

supporting the object on a handling apparatus such that the object extends out from the handling apparatus towards a printing region;

moving the object on the handling apparatus to a printing region;

effecting relative movement of the printhead and the object, during printing, with a rotational component about an axis of rotation and with a linear component, in which the linear component is at least partially in a direction substantially parallel with the axis of rotation, wherein the nozzle pitch of the printhead is greater than a grid pitch in the nozzle row direction of the image to be printed onto the printing surface; and moving the object on the handling apparatus away from the printing region; and interleaving in the direction of printing.

13. A method of printing according to claim 12, comprising effecting relative motion of the printhead and the object, wherein the nozzle pitch of the printhead is greater than the grid pitch in the nozzle row direction of the image to be printed, and printing substantially all of the print grid in one scan of the printhead.

14. A method of printing according to claim 12, comprising using a number of nozzles N having no common factor with P, other than 1, for a printhead having nozzles at a pitch P times the grid pitch in the direction of the nozzle row.

15. A method of printing according to claim 12, comprising effecting relative movement of the printhead and the object in the direction of the nozzle row, the movement being a distance of LN for each revolution of the object relative to the printhead, where L is the pitch of the printing pattern in the direction of the nozzle row and N is the number of nozzles used for printing the image.

16. A method according to claim 12 comprising carrying out a first pass of the printhead, in which ink is printed at fewer than all of the grid points in the first pass, the method further including printing ink on unprinted grid points in a subsequent pass.

17. Method of printing on a printing surface of a three-dimensional object using an inkjet printhead having a plurality of nozzles, the method comprising effecting relative movement of the printhead and the object during printing with a rotational component about an axis of rotation and with a linear component to print a plurality of spiral paths on the printing surface, wherein a plurality of nozzles are used to print each spiral path.

18. A method according to claim 17 wherein a first nozzle is used to print a first set of printed dots of the spiral path and a second nozzle is used to print a second set of printed dots of the spiral path, wherein the dots of the first set are interleaved with dots of the second set.

19. A method of printing according to claim 18 comprising using a number of printhead nozzles equal to Kn, where n is a number of printing paths to be printed in the direction of printing and where K is a number of interleaves in the printing direction and n has no common factor with P, other than 1, a ratio of the nozzle pitch to the grid pitch in the nozzle row direction.

20. A method according to claim 18 wherein the nozzle pitch of the printhead is greater than the grid pitch in the nozzle row direction of the image to be printed, and printing substantially al of the print grid in one scan of the printhead.

21. A method according to claim 18, comprising using a number of nozzles N having no common factor with P, other than 1, for a printhead having nozzles at a pitch P times the grid pitch in the direction of the nozzle row.

22. A method according to claim 18, comprising effecting relative movement of the printhead and the object in the direction of the nozzle row, the movement being a distance of LN for each revolution of the object relative to the printhead, where L is the pitch of the printing pattern in the direction of the nozzle row, and N is the number of nozzles used for printing the image.

23. A method according to claim 18 comprising carrying out a first pass of the printhead, in which ink is printed at fewer than all of the grid points in the first pass, the method further including printing ink on unprinted grid points in a subsequent pass.

24. A method of printing on a printing surface of a three-dimensional object, the method comprising:

providing an inkjet printhead including a plurality of nozzles, effecting relative movement of the printhead and the object during printing with a rotational component about an axis of rotation, wherein the printing surface of the object is at non-constant radius with respect to the axis of rotation, and wherein the object is rotated with a variable angular velocity with respect to the printhead so as to cause motion of the printing surface past a nozzle of the printhead with a substantially constant linear velocity.

* * * * *